US008061289B2

(12) United States Patent
Khachaturian

(10) Patent No.: US 8,061,289 B2
(45) **Date of Patent: *Nov. 22, 2011**

(54) MARINE LIFTING APPARATUS

(76) Inventor: Jon Khachaturian, New Orleans, LA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/435,134

(22) Filed: May 4, 2009

(65) Prior Publication Data

US 2009/0301372 A1 Dec. 10, 2009

Related U.S. Application Data

(63) Continuation of application No. 11/610,271, filed on Dec. 13, 2006, now Pat. No. 7,527,006.

(60) Provisional application No. 60/743,917, filed on Mar. 29, 2006.

(51) Int. Cl.
*B63C 7/00* (2006.01)

(52) U.S. Cl. ..... 114/51

(58) Field of Classification Search ..... 114/50, 114/51, 53, 61.1, 61.15, 61.16; 405/204, 405/209

See application file for complete search history.

(56) References Cited

U.S. PATENT DOCUMENTS

| | | | | |
|---|---|---|---|---|
| 2,378 | A * | 12/1841 | Custis | 114/51 |
| 485,398 | A | 11/1892 | Tyler et al. | |
| 541,794 | A | 6/1895 | Schon | |
| 1,659,647 | A | 2/1928 | McAllister | |
| 3,645,405 | A | 2/1972 | Stiglich | |
| 3,807,336 | A | 4/1974 | Briggs | |
| 4,385,583 | A | 5/1983 | Ayers | |
| 4,714,382 | A | 12/1987 | Khachaturian | |
| 5,054,415 | A | 10/1991 | Marshall | |
| 5,607,260 | A | 3/1997 | Khachaturian | |
| 5,609,441 | A | 3/1997 | Khachaturian | |
| 5,662,434 | A | 9/1997 | Khachaturian | |
| 5,800,093 | A | 9/1998 | Khachaturian | |
| 5,836,463 | A | 11/1998 | Khachaturian | |
| 5,863,085 | A | 1/1999 | Khachaturian | |
| 5,975,807 | A | 11/1999 | Khachaturian | |
| 6,000,562 | A | 12/1999 | Khachaturian | |
| 6,039,506 | A | 3/2000 | Khachaturian | |
| 6,079,760 | A | 6/2000 | Khachaturian | |

(Continued)

FOREIGN PATENT DOCUMENTS

| | | |
|---|---|---|
| JP | 58-122694 | 8/1983 |

(Continued)

*Primary Examiner* — Ed Swinehart

(74) *Attorney, Agent, or Firm* — Garvey, Smith, Nehrbass & North, L.L.C.; Charles C. Garvey, Jr.

(57) ABSTRACT

A catamaran lifting apparatus is disclosed for lifting objects in a marine environment. The apparatus includes first and second spaced apart barges. First and second frames span between the barges. The frames are spaced apart and connected to the barges in a configuration that spaces the barges apart. The first frame connects to the first barge with a universal joint and to the second barge with a hinged connection. The second frame connects to the second barge with a universal joint and to the first barge with a hinged connection. The hull arrangement provides flexibility in a quartering sea state due to the universal joint and hinge placement between the frames and the hulls. Each frame extends upwardly in an inverted u-shape, providing a space under the frame and in between the barges that enables a marine vessel to be positioned in between the barges and under the frames.

53 Claims, 14 Drawing Sheets

U.S. PATENT DOCUMENTS

| | | | | |
|---|---|---|---|---|
| 6,149,350 | A | 11/2000 | Khachaturian | |
| 6,213,319 | B1 | 4/2001 | Khachaturian | |
| 6,296,288 | B1 | 10/2001 | Khachaturian | |
| 6,318,931 | B1 | 11/2001 | Khachaturian | |
| 6,364,574 | B1 | 4/2002 | Khachaturian | |
| 6,367,399 | B1 | 4/2002 | Khachaturian | |
| 6,412,649 | B1 | 7/2002 | Khachaturian | |
| 6,425,710 | B1 | 7/2002 | Khachaturian | |
| 6,435,773 | B1 | 8/2002 | Khachaturian | |
| 6,435,774 | B1 | 8/2002 | Khachaturian | |
| 6,601,717 | B1 | 8/2003 | Khachaturian | |
| 6,692,190 | B2 | 2/2004 | Khachaturian | |
| 6,719,495 | B2 | 4/2004 | Khachaturian | |
| 7,066,343 | B1 | 6/2006 | Khachaturian | |
| 7,399,018 | B1 | 7/2008 | Khachaturian | |
| 7,527,006 | B2 * | 5/2009 | Khachaturian | 114/50 |
| 7,845,296 | B1 | 12/2010 | Khachaturian | |
| 7,886,676 | B2 | 2/2011 | Khachaturian | |
| 2009/0301372 | A1 | 12/2009 | Khachaturian | |

FOREIGN PATENT DOCUMENTS

| | | |
|---|---|---|
| KR | 2010-0008652 | 1/2010 |
| WO | WO 99-13164 | 3/1999 |

* cited by examiner

MARINE LIFTING APPARATUS

CROSS-REFERENCE TO RELATED APPLICATIONS

This is a continuation of co-pending U.S. patent application Ser. No. 11/610,271, filed Dec. 13, 2006, which is incorporated herein by reference.

Priority of U.S. Provisional Patent Application Ser. No. 60/743,917, filed Mar. 29, 2006, incorporated herein by reference, is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to marine lifting devices. More particularly, the present invention relates to an improved catamaran type lifting apparatus that employs spaced apart or catamaran hulls, each of the hulls supporting a truss or frame that spans between the hulls at spaced apart positions. Even more particularly, the present invention relates to an improved catamaran lifting apparatus for use in a marine environment, wherein spaced apart frames are connected to the hulls in a configuration that spaces the vessels apart, the first frame connecting with a first of the hulls with the universal joint and to the second hull with a hinged connection, the second frame connecting to the second hull with a universal joint and to the first hull with a hinged connection.

2. General Background

A catamaran lifting apparatus that can be used to lift multi-ton objects employs two spaced apart barges or hulls or vessels. In general, such lifting devices that employ a pair of spaced apart hulls have been patented, many patents having been issued to applicant as contained in the following table.

TABLE 1

| PAT. NO. | TITLE | ISSUE DATE |
|---|---|---|
| 4,714,382 | Method and Apparatus for the Offshore Installation of Multi-Ton Prefabricated Deck Packages on Partially Submerged Offshore Jacket Foundations | Dec. 22, 1987 |
| 5,607,260 | Method and Apparatus for the Offshore Installation of Multi-Ton Prefabricated Deck Packages on Partially Submerged Offshore Jacket Foundations | Mar. 01, 1997 |
| 5,609,441 | Method and Apparatus for the Offshore Installation of Multi-Ton Prefabricated Deck Packages on Partially Submerged Offshore Jacket Foundations | Mar. 11, 1997 |
| 5,662,434 | Method and Apparatus for the Offshore Installation of Multi-Ton Prefabricated Deck Packages on Partially Submerged Offshore Jacket Foundations | Sep. 02, 1997 |
| 5,800,093 | Method and Apparatus for the Offshore Installation of Multi-Ton Packages Such as Deck Packages, Jackets, and Sunken Vessels | Sep. 01, 1998 |
| 5,975,807 | Method and Apparatus for the Offshore Installation of Multi-Ton Packages Such as Deck Packages and Jackets | Nov. 02, 1999 |

TABLE 1-continued

| PAT. NO. | TITLE | ISSUE DATE |
|---|---|---|
| 6,039,506 | Method and Apparatus for the Offshore Installation of Multi-Ton Packages Such as Deck Packages and Jackets | Mar. 21, 2000 |
| 6,149,350 | Method and Apparatus for the Offshore Installation of Multi-Ton Packages Such as Deck Packages and Jackets | Nov. 21, 2000 |
| 6,318,931 | Method and Apparatus for the Offshore Installation of Multi-Ton Packages Such as Deck Packages and Jackets | Nov. 20, 2001 |
| 6,364,574 | Method and Apparatus for the Offshore Installation of Multi-Ton Packages Such as Deck Packages and Jackets | Apr. 02, 2002 |

BRIEF SUMMARY OF THE INVENTION

The present invention provides an improved catamaran lifting apparatus that employs first and second spaced apart vessels or hulls. The vessels can be barges, dynamically positioned marine vessels, other floating hulls or the like.

A first frame or truss spans between the vessels or hulls at a first position. A second frame or truss spans between the hulls at a second position. The first and second positions are spaced apart so that each frame can move independently of the other, notwithstanding wave action acting upon the hulls. Load spreaders can provide an interface between each frame or truss and each vessel (e.g. barge, ship, etc.)

The first of the frames or trusses connects to the first hull or vessel with a universal joint and to the second hull or vessel with a hinged connection. The second frame connects to the second hull with a universal joint and to the first hull with a hinged connection.

The catamaran hull arrangement of the present invention provides longitudinal flexibility in a quartering sea state due to the unique universal joint and hinge placement between the frames or trusses and the hulls or vessels.

Each frame extends upwardly in a generally inverted u-shape that provides space under each frame or truss and in between the vessels or hulls for enabling a marine vessel to be positioned in between the hulls and under the frames. The space in between the hulls or vessels and under the frames or trusses can also be used as clearance for elevating an object to be salvaged from the seabed to a position next to or above the water's surface.

In a plan view, each frame or truss can be generally triangular in shape. Winches and rigging such as a block and tackle arrangement can be used to lift objects with the apparatus of the present invention. The frames can each be of a truss configuration.

In a second embodiment, one or more slings can be provided that connect between a frame and a hull. The connection of each frame to a hull opposite the universal joint can be a pinned or a hinged connection.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein:

FIGS. 9A-9D are fragmentary views of the preferred embodiment of the apparatus of the present invention, wherein FIG. 9B is a sectional, top view taken along lines 9B-9B of FIG. 9A, FIG. 9C is an elevation view taken along lines 9C-9C of FIG. 9A, and FIG. 9D is a sectional view taken along lines 9D-9D of FIG. 9C;

DETAILED DESCRIPTION OF THE INVENTION

Figure 1:
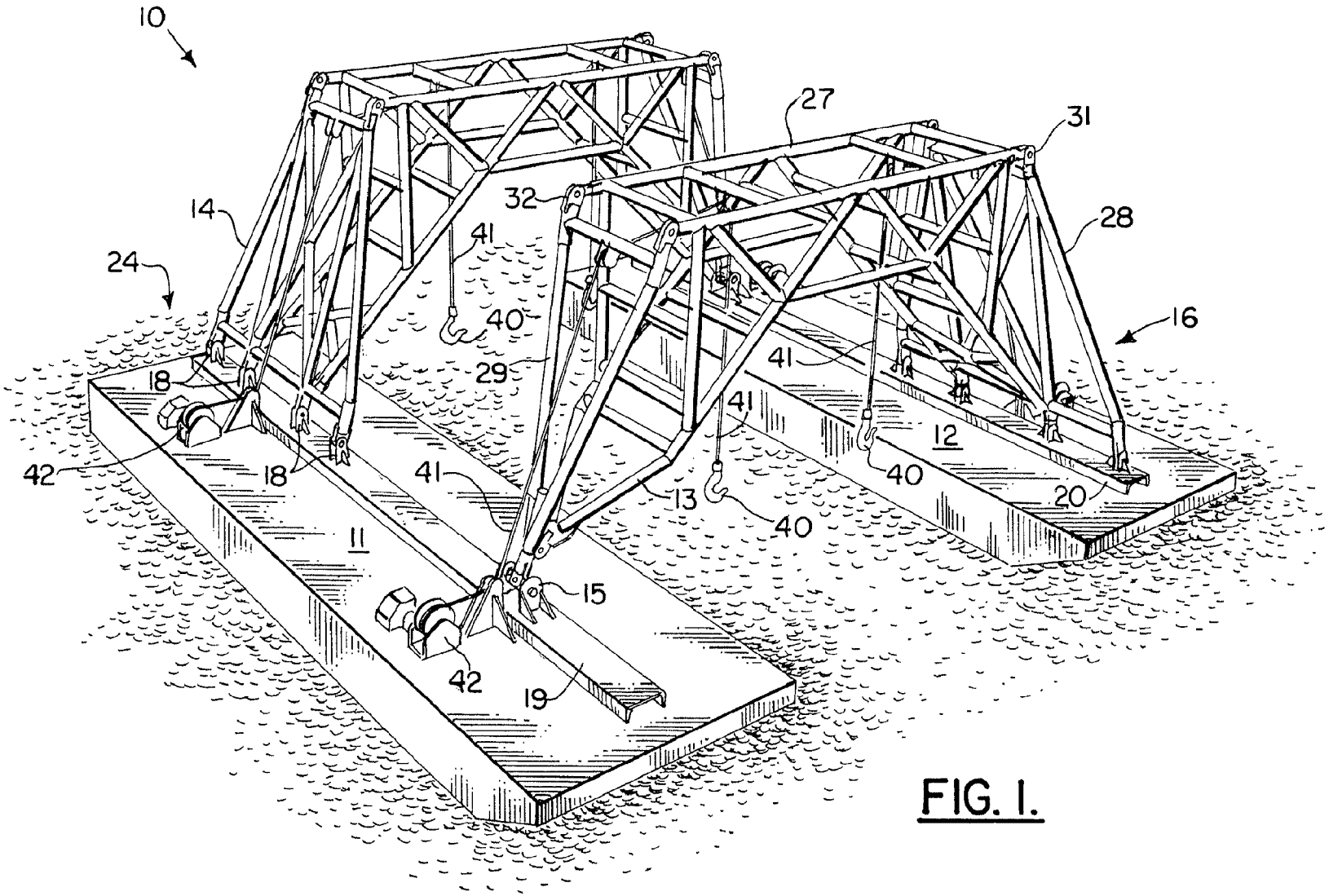
FIG. 1 is a perspective view of the preferred embodiment of the apparatus of the present invention.
Figure 2:
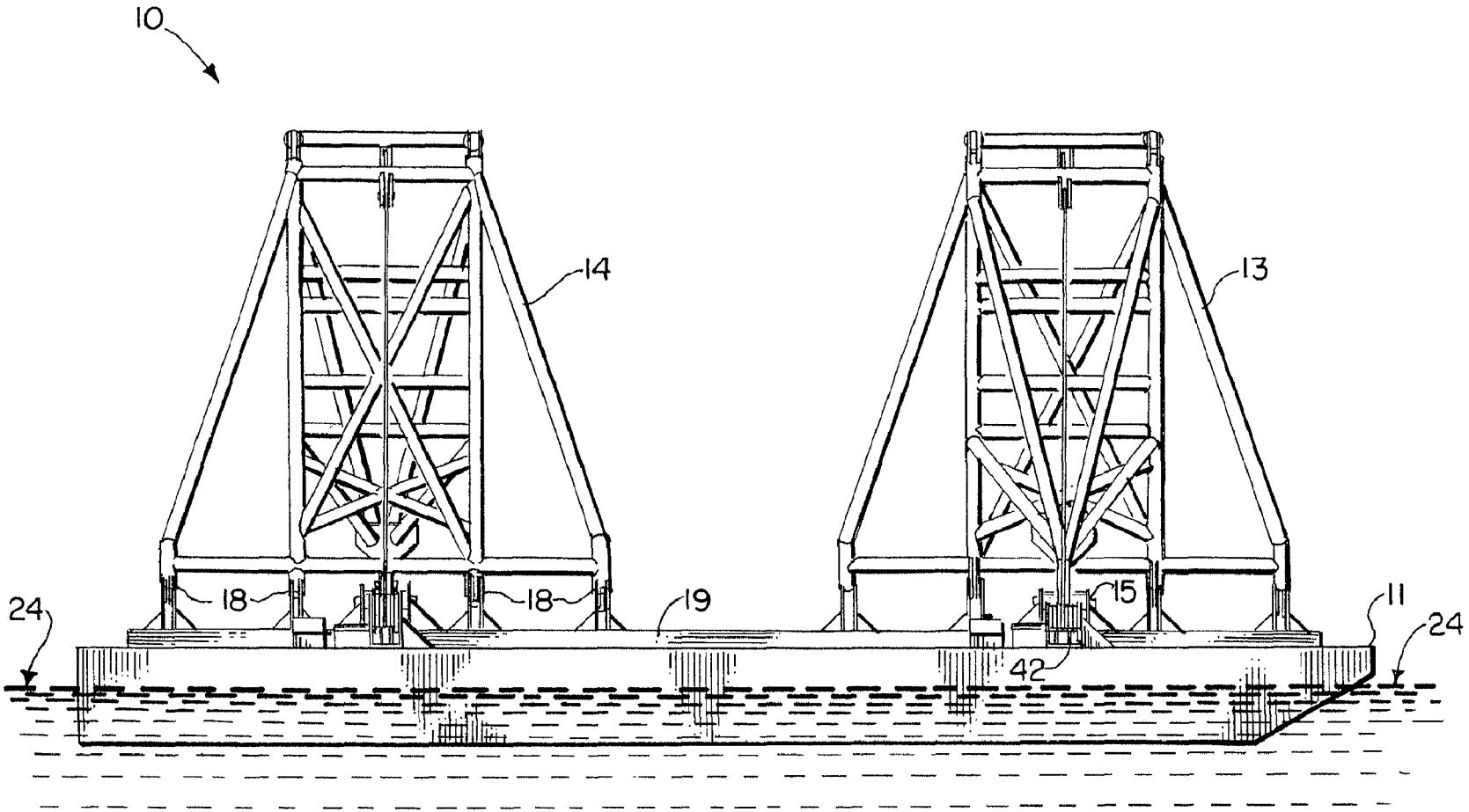
FIG. 2 is a side, elevation view of the preferred embodiment of the apparatus of the present invention.

FIGS. 1-7 and 9-11 show the preferred embodiment of the apparatus of the present invention designated generally by the numeral 10. Marine lifting apparatus 10 provides a pair of spaced apart vessels or hulls 11, 12, each providing a deck 30. Hulls 11, 12 can be barges, dynamically positioned vessels, or any other buoyant structure. A pair of frames or trusses 13, 14 are provided, each frame 13, 14 spanning between the vessels 11, 12. Each frame 13, 14 connects to one vessel 11 or 12 with a universal joint 15 or 17 (see FIGS. 1, 4, 9) and to the other hull 11 or 12 with a hinged or pinned connection 16 or 19 (see FIG. 4).

The first frame 13 connects to hull 11 with universal joint 15 (or articulating connection). The first frame 13 connects to vessel 12 with a pinned connection or hinge 16. Similarly, the second frame 14 connects to hull 12 with a universal joint 17 (or articulating connection) and to hull 11 with a hinge or pinned connection 18 (see FIG. 4).

An interface such as a deck beam or load spreader platform can be provided on the upper deck 30 of each hull 11, 12 for forming an interface between the frames 13, 14 and the vessels 11, 12. For example, vessel 11 is provided with deck beam or load spreader platform 19 on its deck 30 that forms an interface between each of the frames 13, 14 and the barge or vessel 11 deck 30. Deck beam or load spreader platform 20 provides an interface between each of the frames 13, 14 and deck 30 of the vessel or barge 12.

Figure 4:
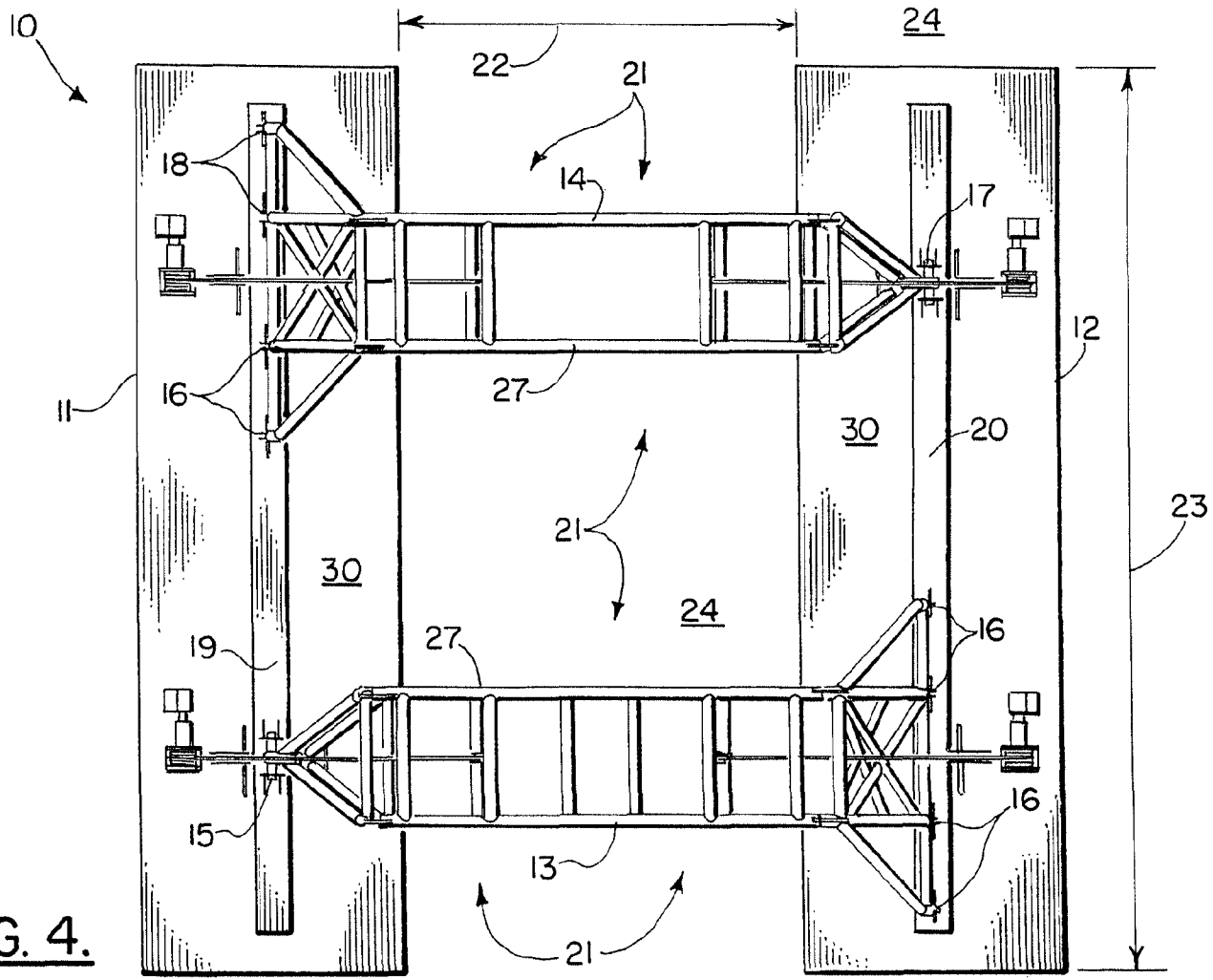
FIG. 4 is a top plan view of the preferred embodiment of the apparatus of the present invention.
Figure 5:
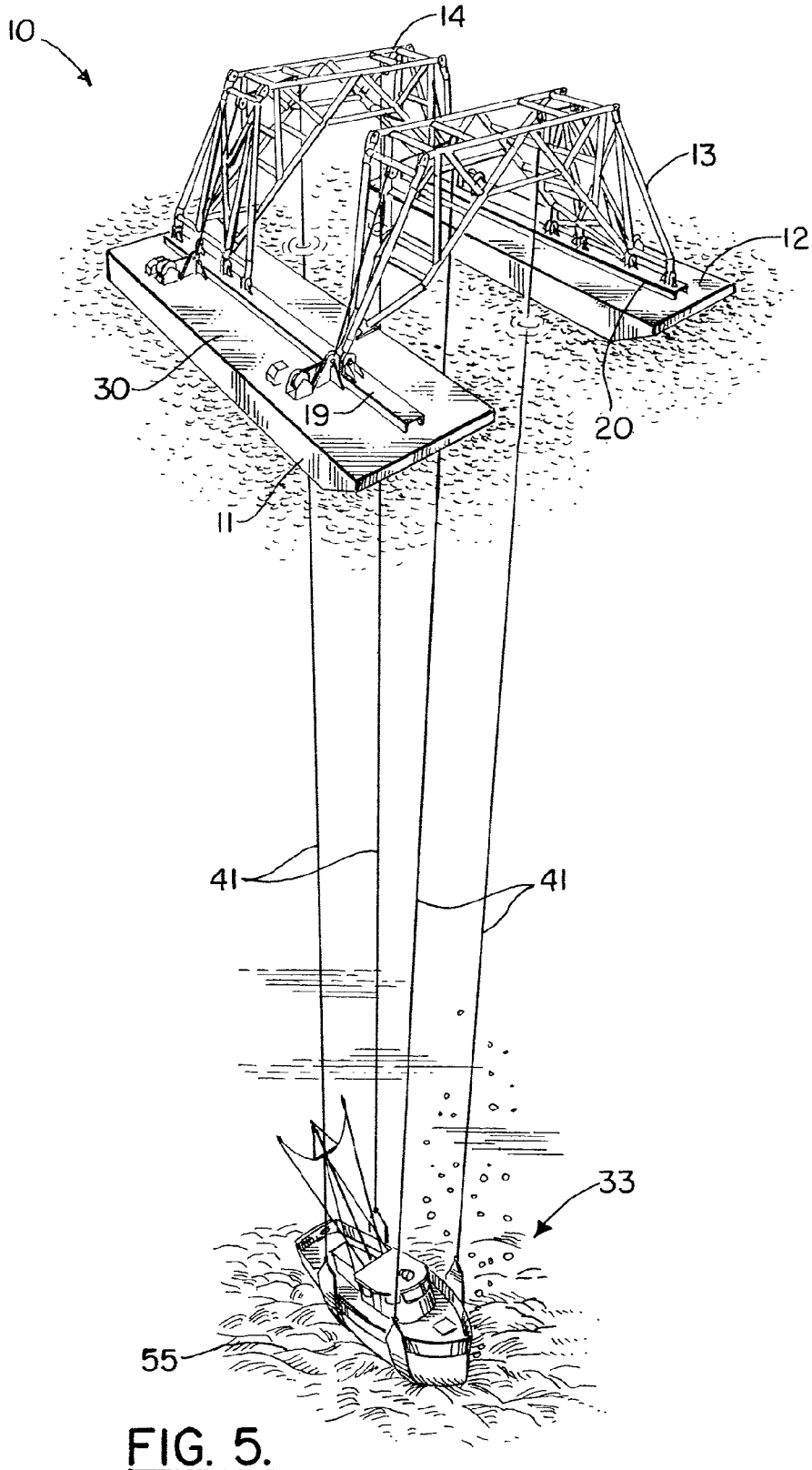
FIG. 5 is a perspective view of the preferred embodiment of the apparatus of the present invention.

In FIG. 4, a plan or top view of the apparatus 10 of the present invention is shown. A lifting area 21 is that area that is in between the vessels 11, 12, the area 21 having a length defined by dimension arrow 23 and a width defined by dimension arrow 22 in FIG. 4. This area 21 is sized and shaped to receive a vessel having a cargo to be lifted if that cargo (e.g. deck package) is to be installed. Alternatively, the area 21 can be an area that receives a vessel for supporting and transporting an item to be salvaged from an ocean floor (see FIGS. 5 and 11-15) such as a hurricane smashed or damaged offshore platform section 34, sunken boat 33 or the like. In either case, a clearance is provided above the water surface 24.

Figure 3:
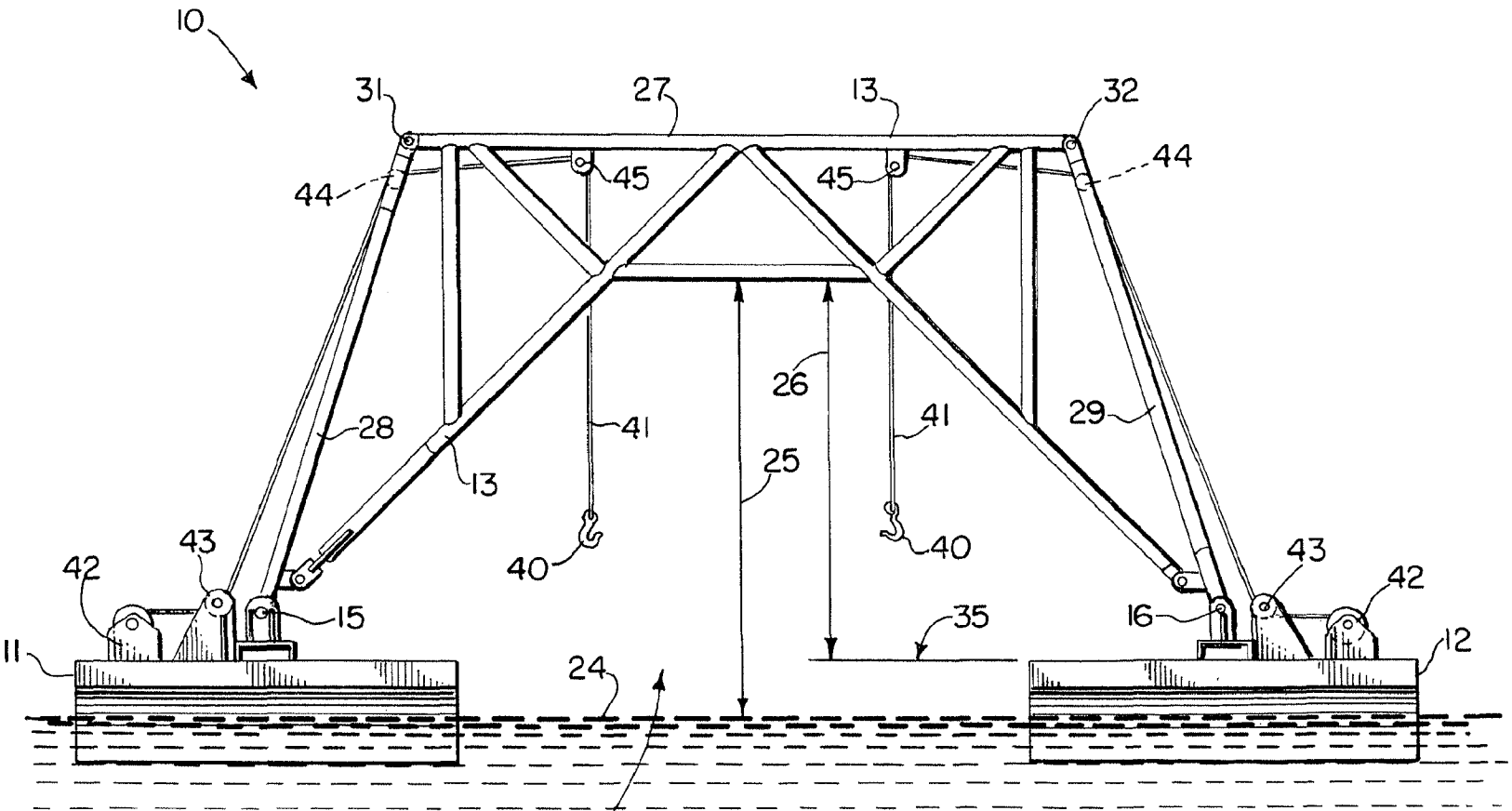
FIG. 3 is an end elevation view of the preferred embodiment of the apparatus of the present invention, with each winch and lifting line removed for clarity.

In FIG. 3, a clearance between water surface 24 and frame 13 or 14 is indicated schematically by the dimension line 25. Similarly, a clearance 26 is provided above the maximum deck elevation 35 of the hulls 11, 12 as shown in FIG. 3.

Each of the frames 13, 14 can be in the form of a truss as shown. The frames are generally speaking in the shape of an arch or inverted U so that an area is provided under the frames and above the water surface for raising an item that is being salvaged or to lift an item from a barge or other vessel or support that is under the frames. Each truss or frame 13, 14 can be a one piece structure (see FIG. 10) or a multi-section truss (see FIGS. 1-4). For multi-section frames 13, 14 they provide a center truss section 27, a smaller side truss section 28 and another smaller side truss section 29. Pinned connections 31, 32 can be provided for attaching the smaller truss sections 28, 29 to the larger center truss section 27 as shown in FIGS. 3 and 4.

Slings can optionally be provided for connecting the center section 27 to the lower end portion of each of the smaller truss sections 28, 29. Shackles can be used to attach each of the slings to eyelets or padeyes on the center section 27. Likewise, shackles can be used to attach the slings to eyelets or padeyes on the smaller truss sections 28, 29.

Figure 13:
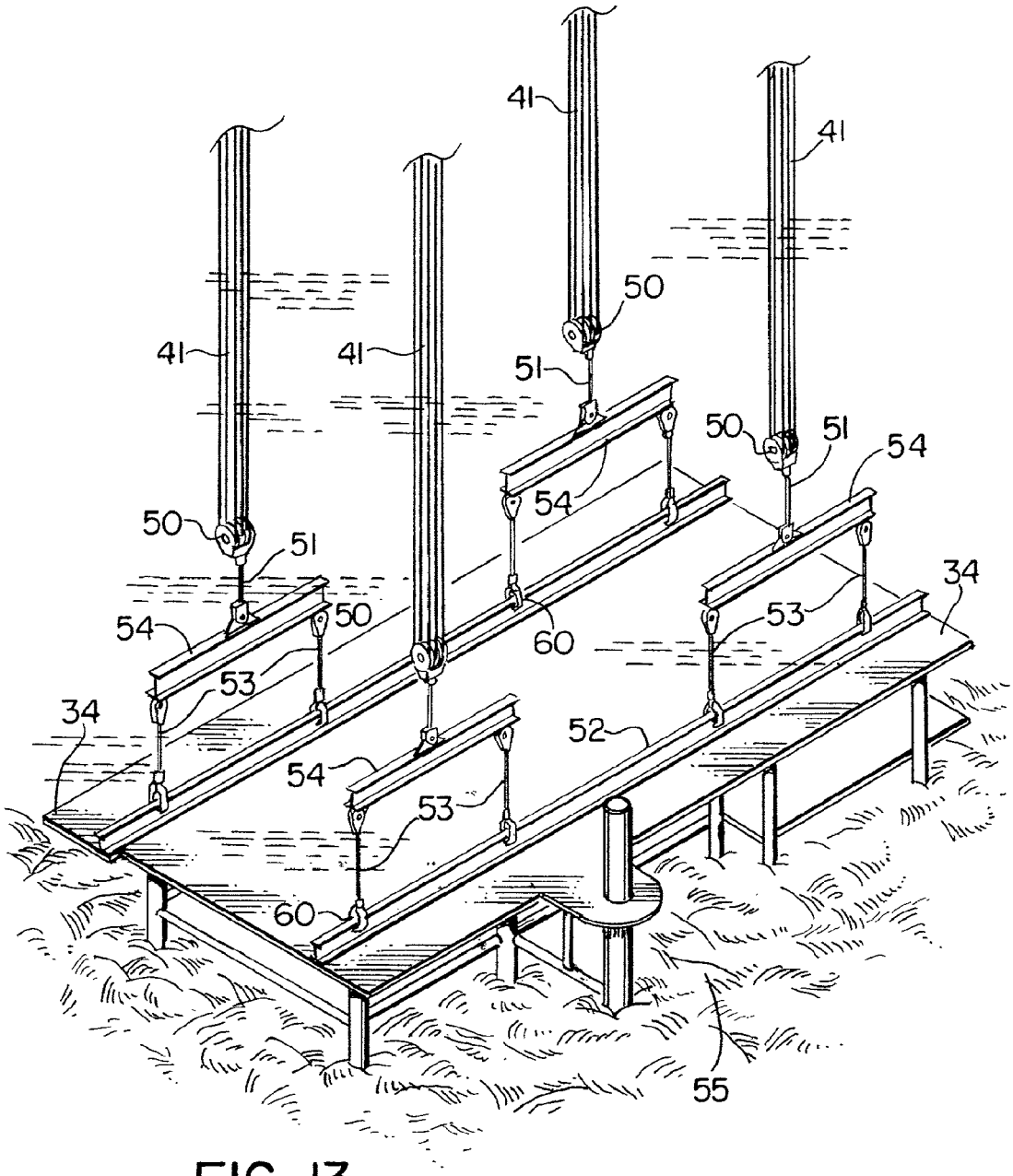
FIG. 13 is a partial perspective view of the preferred embodiment of the apparatus of the present invention and showing a method step of the present invention.

A hook 40 or other lifting fitting can be attached to a lifting line 41 and payed out from winch 42. More than one lifting line 41 and hook 40 can be provided as shown. Sheaves 43, 44, 45 as needed can be used to route the line 41 from winch 42 to hook 40. Line 41 can be a multiple line assembly to increase lift capacity such as is shown in FIG. 13. Hook 40 can be any lifting fitting such as any known commercially available crown block, for example.

Figure 6:
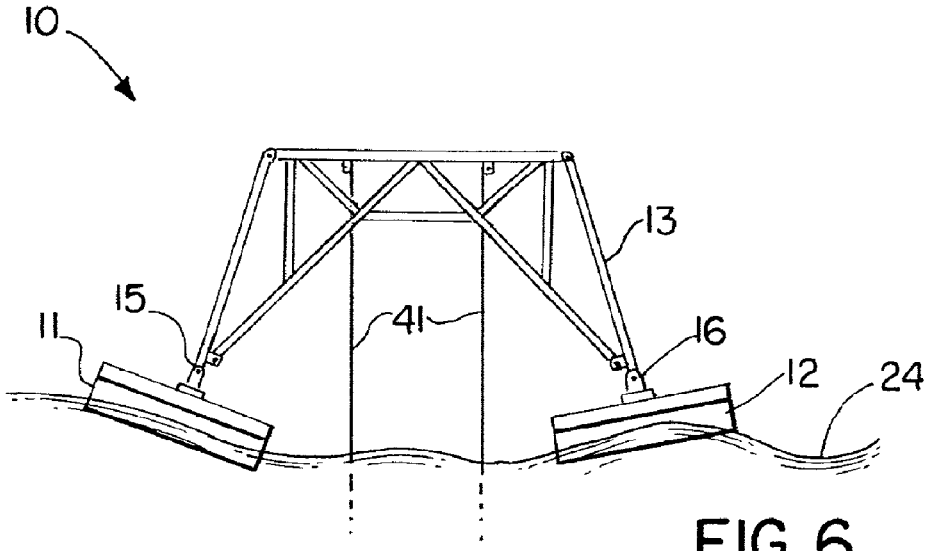
FIGS. 6-8 are schematic illustrations of a rough sea condition.
Figure 7:
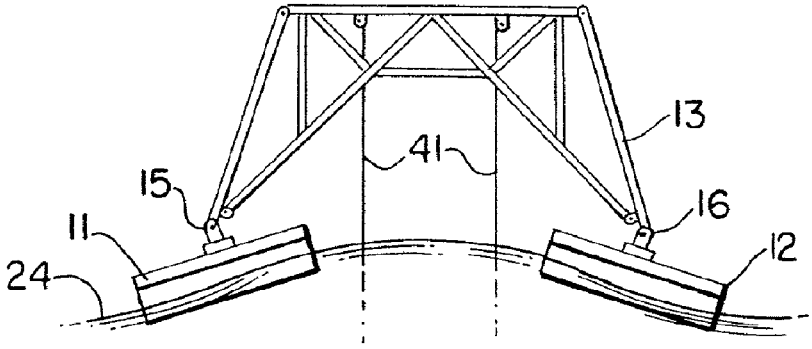
Figure 8:
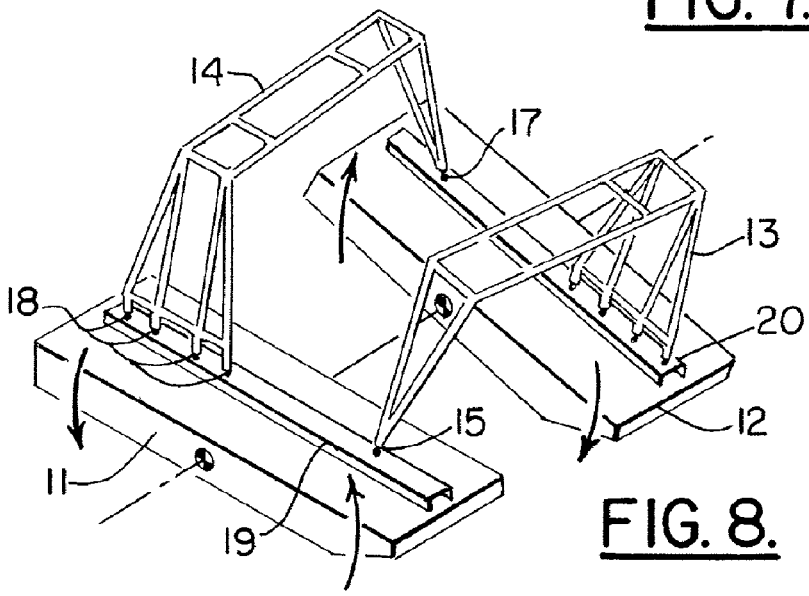
Figure 9A:
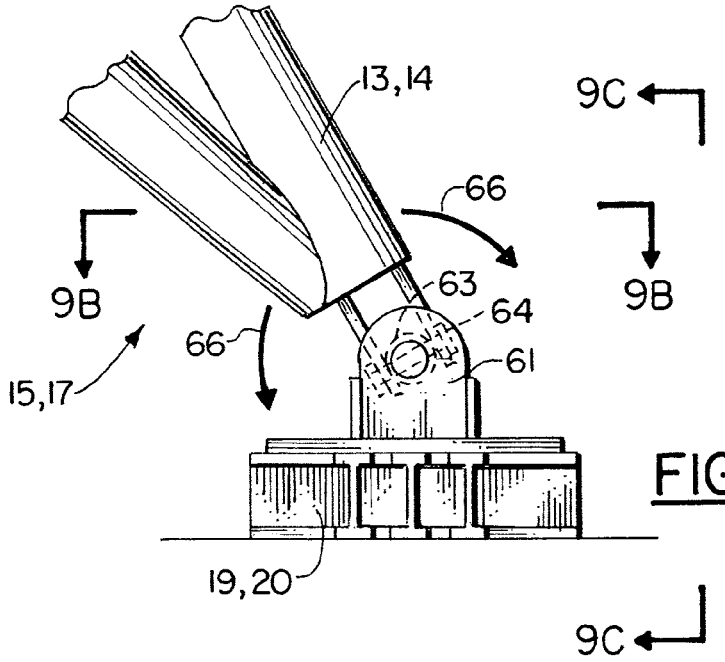
Figure 9B:
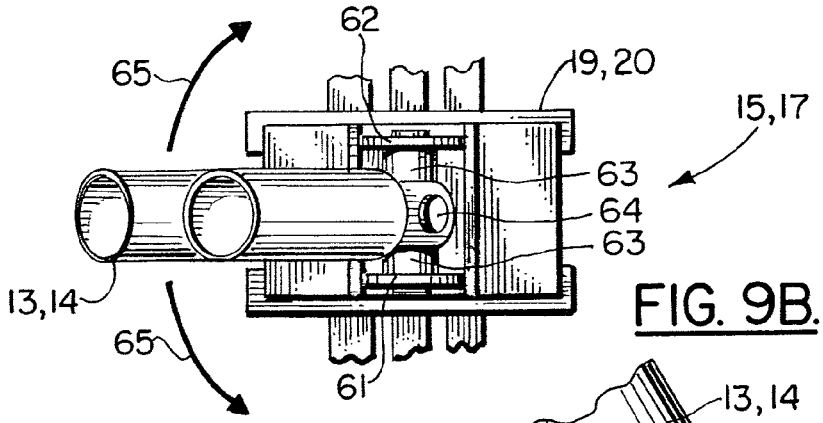
Figure 9C:
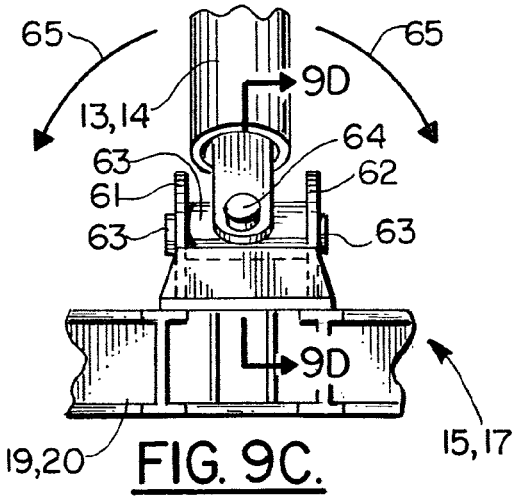
Figure 9D:
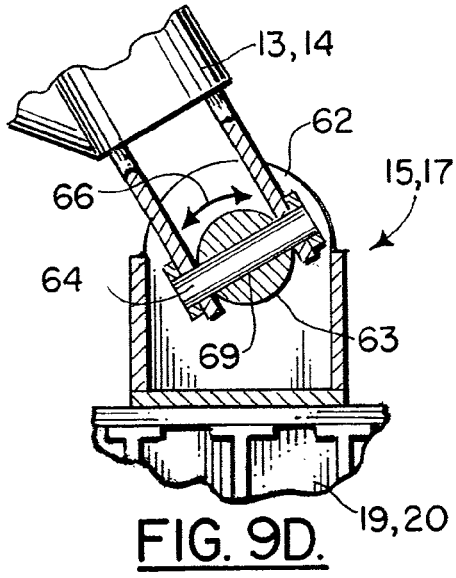

FIGS. 6-9 illustrate the articulation that is achieved with the method and apparatus of the present invention, even in rough seas. In FIGS. 6 and 7, rough sea conditions are shown wherein the vessels 11, 12 assume differing orientations relative to each other caused by the rough sea state. Notwithstanding the orientation of the vessels 11, 12 the combination of an articulating connection 15, 17 with hinged or pinned connections 16, 18 enables complete articulation between each of the frames or trusses 13, 14 and each of the vessels or hulls 11, 12.

In FIGS. 9A-9D, an exemplary articulating connection 15, 17 is shown. In FIGS. 9A-9D, a frame or truss 13, 14 connects to a load spreader platform 19 or 20 at padeyes 61, 62. A first shaft 63 is pivotally attached to the padeyes 61, 62. A second shaft 64 is pivotally attached to the first shaft 63 at opening 69 in first shaft 63. The second shaft 64 also defines a pivotal connection for the frame 13 or 14 to the first shaft 63 as shown. This universal joint arrangement enables the frame 13 (or 14) to move in an articulating fashion with respect to the load spreader platform 19 or 20 and with respect to the underlying vessel 11 or 12 as indicated schematically by arrows 65, 66 in FIG. 9.

FIGS. 10-17 show the preferred embodiment of the apparatus of the present invention when fitted with a block and tackle arrangement. Vessels 11, 12 are also shown fitted with anchor lines 67 that connect conventional anchors (not shown) to anchor winches 68 on the vessels 11, 12. The anchor winches 68 can be used to exactly position vessels 11, 12 and to stabilize their positions during a lift. A block and tackle arrangement (FIGS. 10-17) can be used to lift an item to be salvaged from the seabed 55 such as the damaged platform section 34 in FIG. 11.

Figure 10:
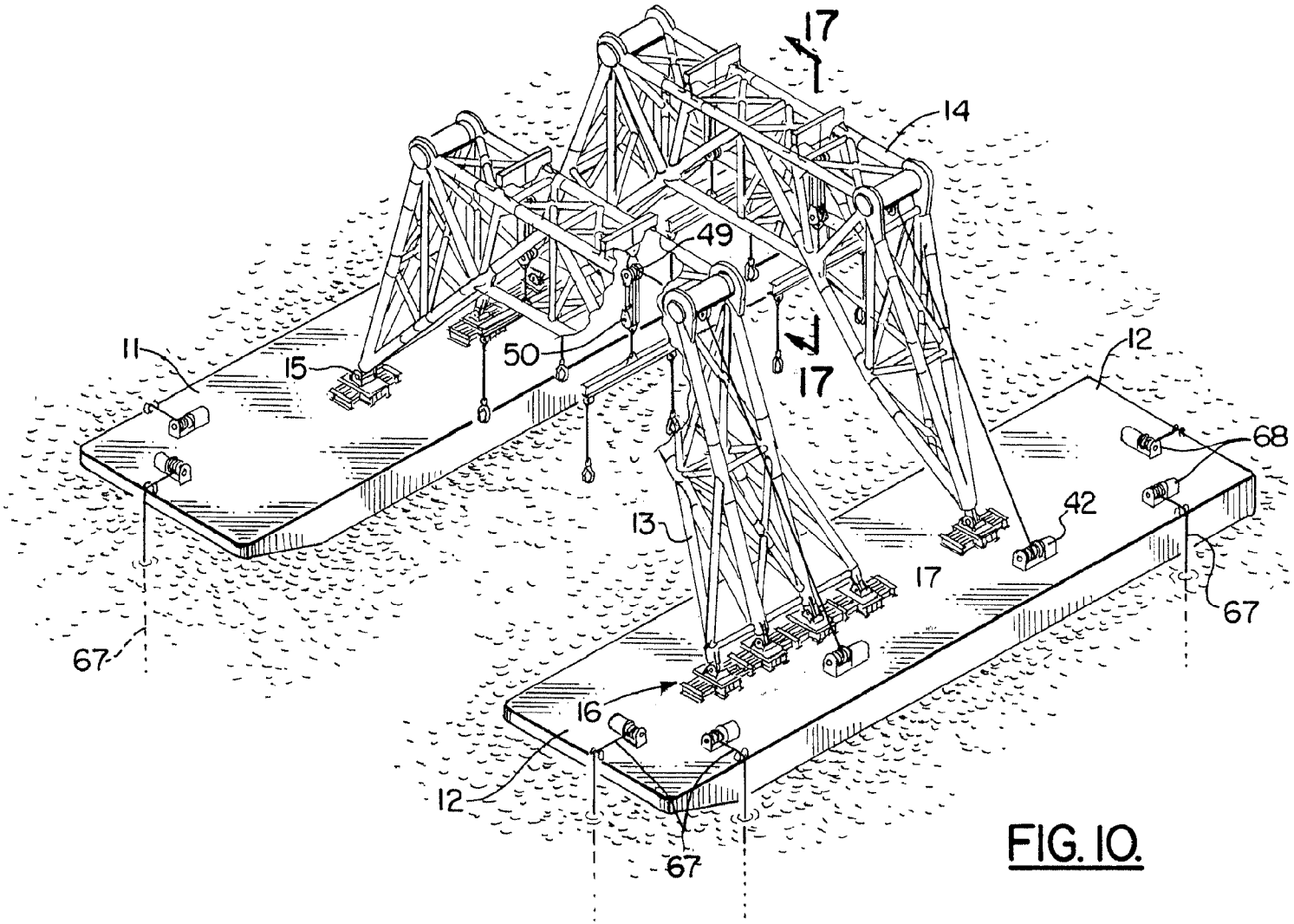
FIG. 10 is a perspective view of the preferred embodiment of the apparatus of the present invention showing a block and tackle rigging with winches and lift lines.
Figure 11:
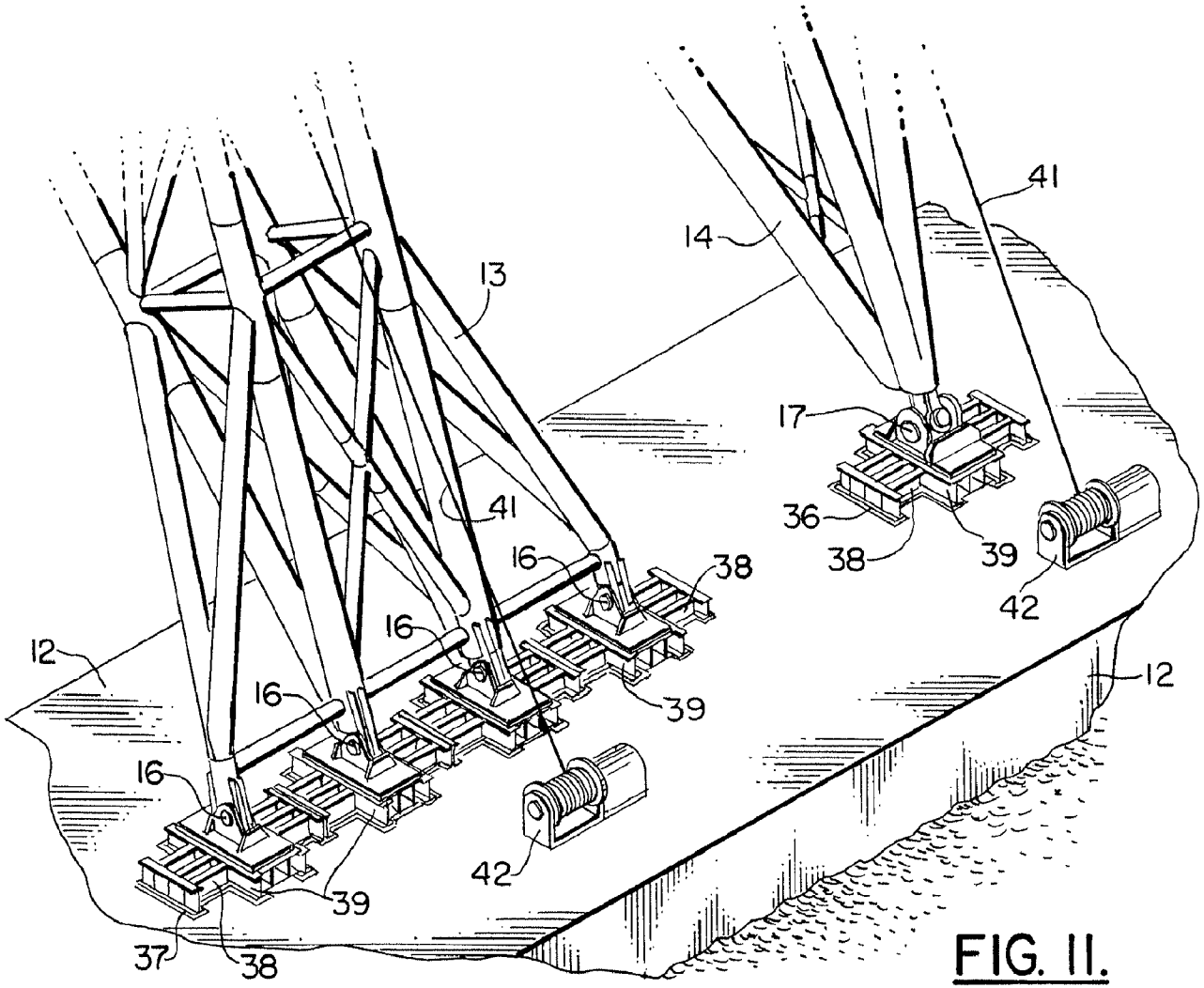
FIG. 11 is a fragmentary perspective view of the preferred embodiment of the apparatus of the present invention.
Figure 12:
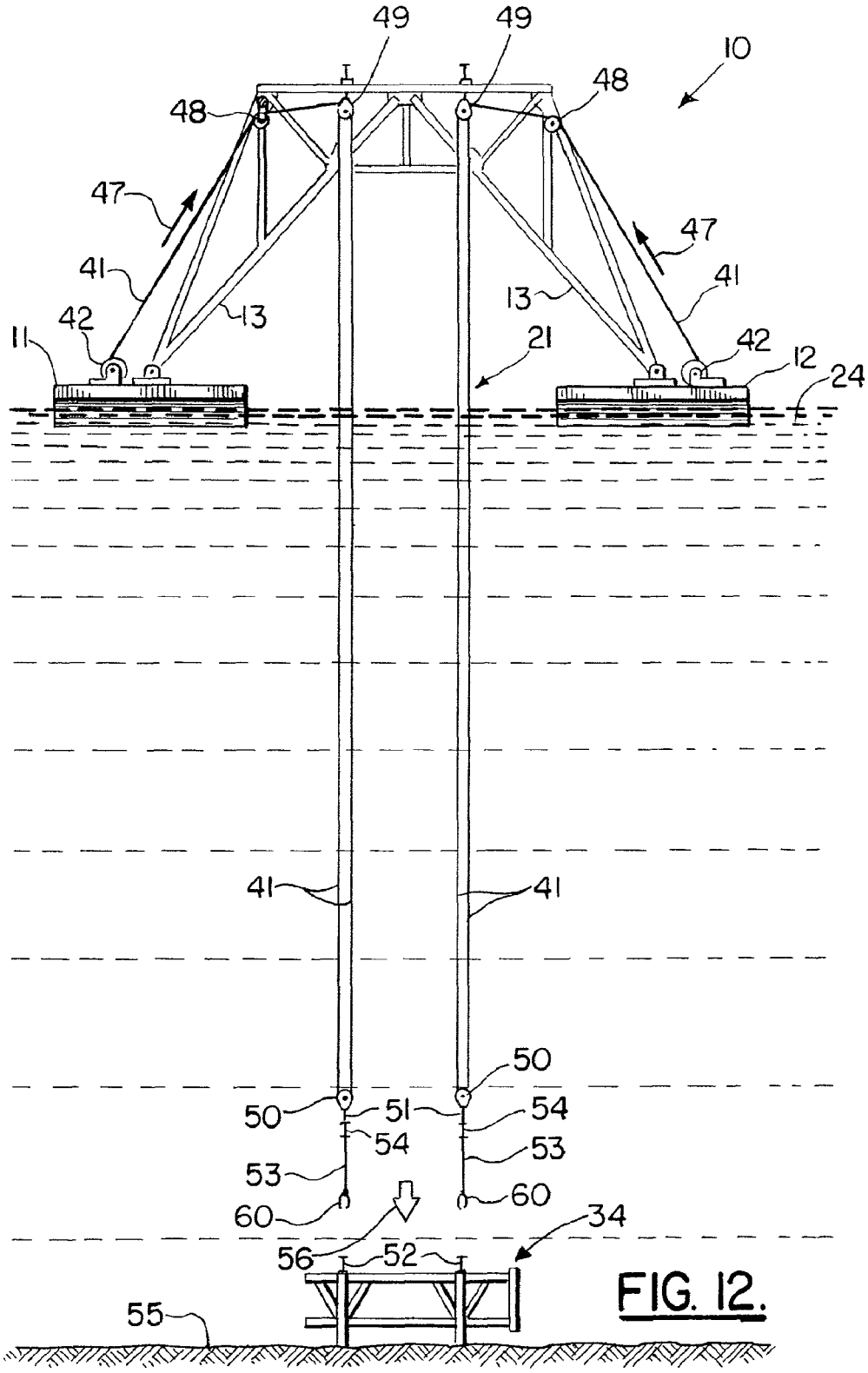
FIG. 12 is an elevation view of the preferred embodiment of the apparatus of the present invention and showing a method step of the present invention.
Figure 15:
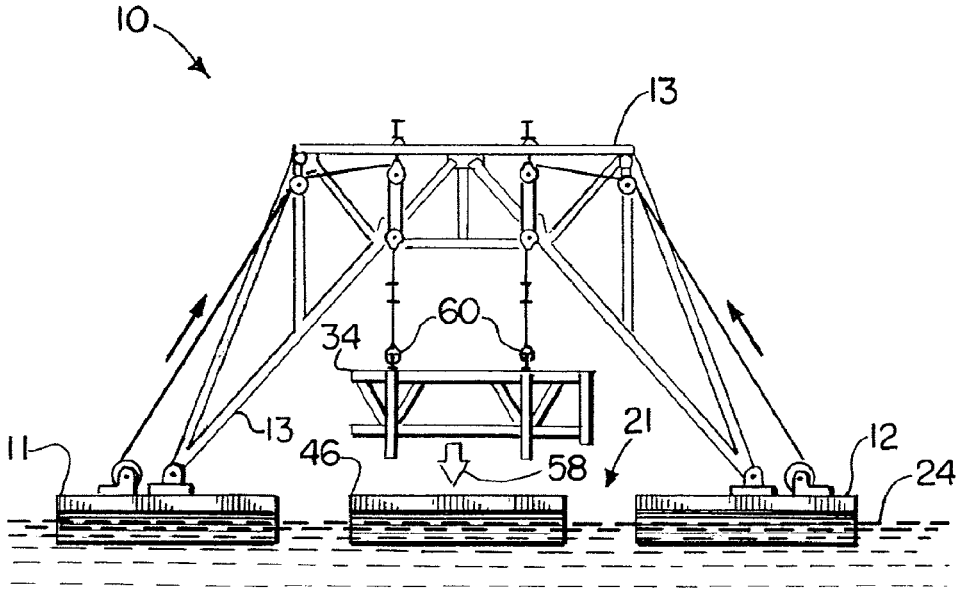
FIGS. 15-16 are elevation views that further illustrate the method of the present invention.
Figure 16:
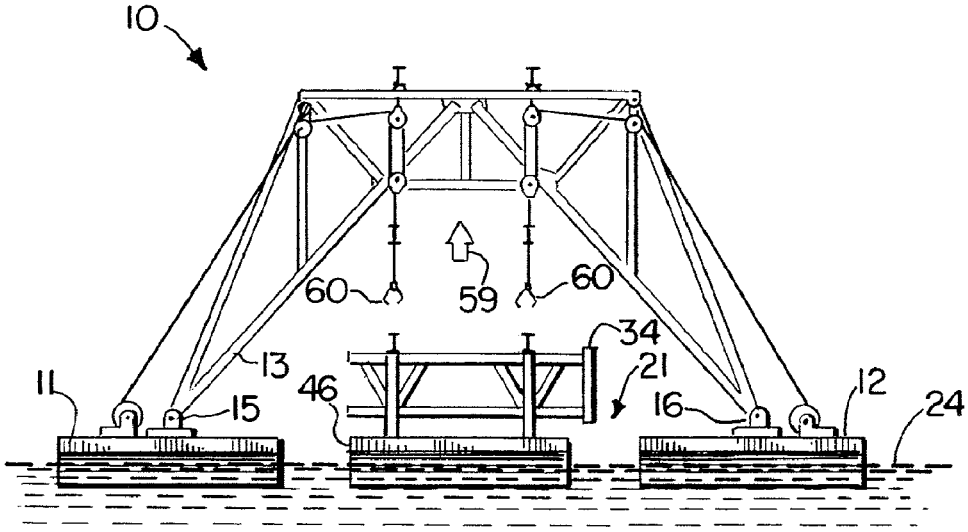
Figure 17:
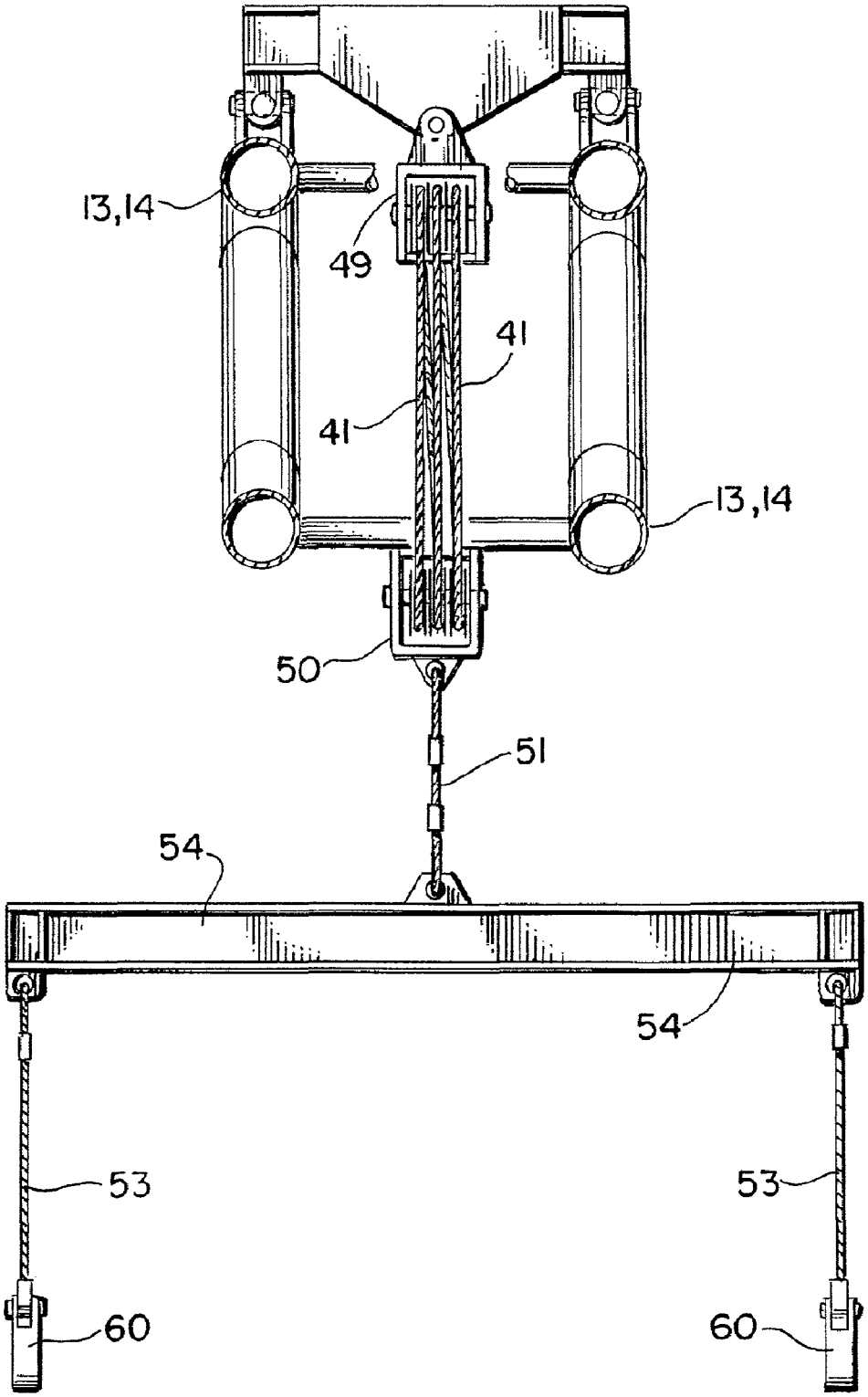
FIG. 17 is a sectional view taken along lines 17-17 of FIG. 10.

In FIGS. 10-17, each of the frames 13, 14 is rigged with an upper sheave 48 and upper pulley block 49. Each frame 13 or 14 can be rigged with a lifting line 41 and one or more winches 42. In FIGS. 10-12 for example, each frame 13, 14 has two winches 42, each winch 42 having a lifting line or cable 41. Lower pulley block 50 is positioned below upper pulley block 49. The pulley blocks 49, 50 can provide multiple pulleys such as is shown in FIGS. 10, 13 and 17. Slings 51 can be rigged to each lower pulley block 50. Each sling 51 can support a lifting beam or spreader bar 54. Each spreader bar 54 can support one or more slings 53 as shown in FIGS. 12, 17. The slings 53 can be provided with any selected additional rigging such as clamps, shackles or grabs 60, as examples. Arrows 47 in FIG. 12 show lines 41 being payed out to lower the lower pulley blocks 50 to damaged platform section 34 (see arrow 56, FIG. 12).

Figure 14:
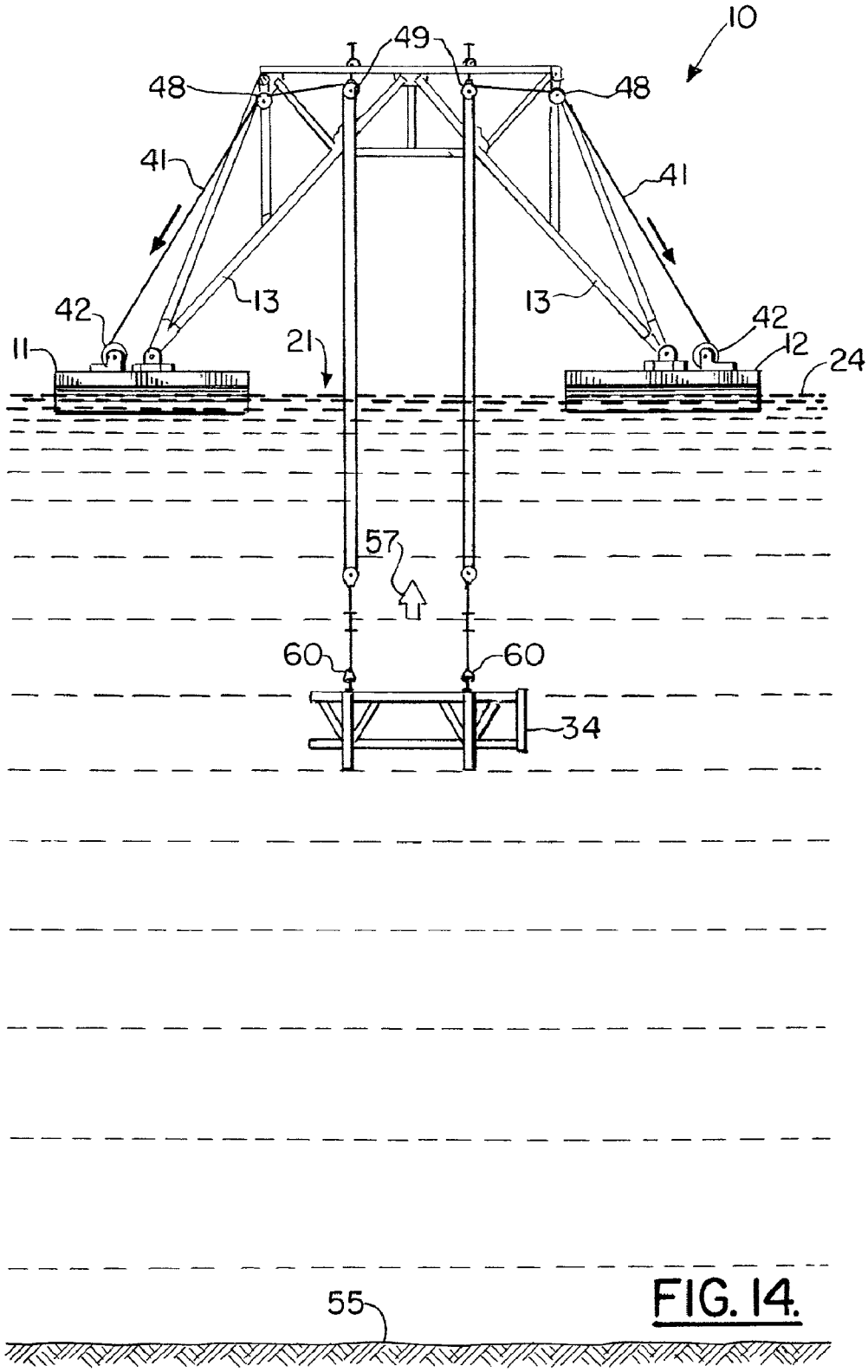
FIG. 14 is an elevation view of the preferred embodiment of the apparatus of the present invention and illustrating the method of the present invention.

The damaged platform section 34 to be salvaged can be fitted with beams 52 such as I-beams as an example. As the damaged or sunken platform section 34 rests upon seabed 55, grabs 60 can be attached to the beams 52 with slings 53 as shown in FIG. 12 for a lifting operation. Arrow 56 in FIG. 12 schematically illustrates a lowering of the lower pulley blocks 50 to the sunken, damaged platform section 34. After the grabs 60 are connected to the beams 52, arrow 57 in FIG. 14 schematically illustrates an elevating of the platform section 34 as each line 41 is wound upon its winch 42.

In FIG. 15, the transport vessel 46 is moved into the area 21 under frames 12, 13, 14. Arrow 58 schematically illustrates a lowering of the damaged platform section 34 to the vessel 46. In FIG. 16, grabs 60 have been released from beams 52 and lifted upwardly in the direction of arrow 59, away from the damaged platform section 34. The damaged or salvaged item such as a vessel 33 or damaged platform section 34 can then be transported to a selected locale using the transport vessel or transport barge 46.

In FIG. 11, an alternate load spreader platform construction is shown. A smaller load spreader platform 36 is placed under each universal joint 15 or 17 of the frame 13 or 14. A larger load spreader platform 37 is placed under each pinned connection or hinge 16 or 18 of the frame 13 or 14. Each platform 36, 37 can comprise a plurality of longitudinal beams 38 and a plurality of transverse beams 39 as shown. The beams 38, 39 can be structurally connected together (e.g. welded together).

The following is a list of parts and materials suitable for use in the present invention.

PARTS LIST

| Part Number | Description |
|---|---|
| 10 | marine lifting apparatus |
| 11 | vessel |
| 12 | vessel |
| 13 | first frame or truss |
| 14 | second frame or truss |
| 15 | universal joint |
| 16 | hinge |
| 17 | universal joint |
| 18 | hinge |
| 19 | load spreader platform interface |

-continued

| Part Number | Description |
|---|---|
| 20 | load spreader platform interface |
| 21 | area |
| 22 | dimension line |
| 23 | dimension line |
| 24 | water surface |
| 25 | clearance above water |
| 26 | clearance above hull deck |
| 27 | center truss section |
| 28 | smaller truss section |
| 29 | smaller truss section |
| 30 | hull deck |
| 31 | pinned connection |
| 32 | pinned connection |
| 33 | sunken vessel |
| 34 | damaged platform section |
| 35 | maximum deck elevation |
| 36 | load spreader platform |
| 37 | load spreader platform |
| 38 | longitudinal beam |
| 39 | longitudinal beam |
| 40 | lifting hook |
| 41 | lifting line |
| 42 | winch |
| 43 | sheave |
| 44 | sheave |
| 45 | sheave |
| 46 | transport vessel |
| 47 | arrow |
| 48 | upper sheave |
| 49 | upper pulley block |
| 50 | lower pulley block |
| 51 | sling |
| 52 | beam |
| 53 | sling |
| 54 | spreader bar |
| 55 | seabed |
| 56 | arrow |
| 57 | arrow |
| 58 | arrow |
| 59 | arrow |
| 60 | grab |
| 61 | padeye |
| 62 | padeye |
| 63 | first shaft |
| 64 | second shaft |
| 65 | arrow |
| 66 | arrow |
| 67 | anchor line |
| 68 | anchor winch |
| 69 | opening |

All measurements disclosed herein are at standard temperature and pressure, at sea level on Earth, unless indicated otherwise. All materials used or intended to be used in a human being are biocompatible, unless indicated otherwise.

The foregoing embodiments are presented by way of example only; the scope of the present invention is to be limited only by the following claims.

The invention claimed is:

1. A catamaran lifting apparatus comprising:

a) first and second marine vessels;

b) a first frame that spans between the marine vessels;

c) a second frame that spans between the marine vessels;

d) the frames being spaced apart and being connected to the marine vessels in a configuration that spaces the marine vessels apart;

e) the first frame connecting to the first vessel with a universal joint that enables rotation of the first frame relative to the first marine vessel about multiple axes and to the second vessel with a hinged connection that enables rotation about a single axis only;

f) the second frame connecting to the second vessel with a universal joint that enables rotation of the rotation of the second frame relative to the second marine vessel about multiple axes, and to the first vessel with a hinged connection that enables rotation about a single axis only;

g) each frame extending upwardly and providing a space under the frame and in between the vessels, enabling a package to be lifted to be positioned in between the marine vessels and under the frames; and h) wherein each frame provides a generally triangular support arrangement in plan view.

2. The catamaran lifting apparatus of claim 1 wherein each frame is connected to two of the vessels with a generally triangular support arrangement in top view that connects to one vessel with a first, smaller width connection and to the second vessel with a second, larger width connection that is wider than the first smaller width connection.

3. The catamaran lifting apparatus of claim 1 wherein the first frame is a truss.

4. The catamaran lifting apparatus of claim 1 wherein the second frame is a truss.

5. The catamaran lifting apparatus of claim 1 further comprising one or more cables that connect between a said frame and a said vessel.

6. The catamaran lifting apparatus of claim 1 further comprising one or more cables that connect between each said frame and each said vessel.

7. The catamaran lifting apparatus of claim 1 wherein the hinge includes multiple pinned connections.

8. The catamaran lifting apparatus of claim 1 wherein the first frame is much wider at one end portion than at its other end portion.

9. The catamaran lifting apparatus of claim 1 wherein the second frame is much wider at one end portion than at its other end portion.

10. A catamaran lifting apparatus comprising:

a) first and second vessels;

b) a first frame that spans between the vessels;

c) a second frame that spans between the vessels;

d) the frames being spaced apart and being connected to the vessels in a configuration that spaces the vessels apart;

e) the first frame connecting to the first vessel with a universal joint and to the second vessel with a hinged connection that is not a universal joint;

f) the second frame connecting to the second vessel with a universal joint, and to the first vessel with a hinged connection that is not a universal joint;

g) each frame extending upwardly and providing a space under the frame and in between the vessels, enabling a marine vessel to position in between the vessels and under the frames; and h) wherein each frame provides a generally triangular support arrangement in plan view.

11. The catamaran lifting apparatus of claim 10 wherein each frame is connected to two of the vessels with a generally triangular support arrangement in top view that connects to one vessel with a first, smaller width connection and to the second vessel with a second, larger connection that is wider than the first connection.

12. The catamaran lifting apparatus of claim 10 wherein the first frame is a truss.

13. The catamaran lifting apparatus of claim 10 wherein the second frame is a truss.

14. The catamaran lifting apparatus of claim 10 further comprising one or more cables that connect between a said frame and a said vessel.

15. The catamaran lifting apparatus of claim 10 further comprising one or more cables that connect between each frame and each vessel.

16. The catamaran lifting apparatus of claim 10 wherein the hinge includes multiple pinned connections.

17. The catamaran lifting apparatus of claim 10 wherein the first frame is much wider at one end portion than at its other end portion.

18. The catamaran lifting apparatus of claim 10 wherein the second frame is much wider at one end portion than at its other end portion.

19. A catamaran lifting apparatus comprising:

a) first and second marine vessels;

b) a first frame that spans between the vessels;

c) a second frame that spans between the vessels;

d) the frames being spaced apart and being connected to the vessels in a configuration that spaces the marine vessels apart;

e) the first frame connecting to the first vessel with a universal joint that enables rotation of the first frame relative to the first vessel about multiple axes and to the second vessel with a hinged connection that does not enable rotation of the first frame relative to the second vessel about multiple axes;

f) the second frame connecting to the second vessel with a universal joint, and to the second vessel with a hinged connection that does not enable rotation of the first frame relative to the second vessel about multiple axes; and g) each frame extending upwardly and providing a space under the frame and in between the vessels, the space enabling an item to be lifted to be positioned in between the vessels and under the frames.

20. The catamaran lifting apparatus of claim 19 wherein each frame provides a generally triangular support arrangement in plan view.

21. The catamaran lifting apparatus of claim 19 wherein each frame is connected to two of the vessels with a generally triangular support arrangement in top view that connects to one vessel with a first, smaller width connection and to the second vessel with a second, larger connection that is wider than the first connection.

22. The catamaran lifting apparatus of claim 19 wherein the first frame is a truss.

23. The catamaran lifting apparatus of claim 19 wherein the second frame is a truss.

24. The catamaran lifting apparatus of claim 19 further comprising one or more cables that connect between a said frame and a said vessel.

25. The catamaran lifting apparatus of claim 19 further comprising one or more cables that connect between each frame and each vessel.

26. The catamaran lifting apparatus of claim 19 wherein the hinge includes multiple pinned connections.

27. The catamaran lifting apparatus of claim 19 wherein the first frame is much wider at one end portion than at its other end portion.

28. The catamaran lifting apparatus of claim 19 wherein the second frame is much wider at one end portion than at its other end portion.

29. The catamaran lifting apparatus of claim 19 wherein each frame has end portions, one end portion being wider than the other at a position where the frame connects to a said vessel.

30. The catamaran lifting apparatus of claim 19 wherein each frame is generally arch shaped.

31. The catamaran lifting apparatus of claim 19, further comprising a lifting line rigged to at least one of the frames.

32. The catamaran lifting apparatus of claim 19, further comprising a lifting line rigged to each of the frames.

33. The catamaran lifting apparatus of claim 19, further comprising a winch wound with a lifting cable, the lifting cable extending from the winch to the frame and providing a lifting end portion.

34. The catamaran lifting apparatus of claim 10, further comprising a lifting line rigged to at least one of the frames.

35. The catamaran lifting apparatus of claim 10, further comprising a lifting line rigged to each of the frames.

36. The catamaran lifting apparatus of claim 10, further comprising a winch wound with a lifting cable, the lifting cable extending from the winch to the frame and providing a lifting end portion.

37. The vessel lifting apparatus of claim 19, further comprising a lifting line rigged to at least one of the frames.

38. The vessel lifting apparatus of claim 19, further comprising a lifting line rigged to each of the frames.

39. The catamaran vessel lifting apparatus of claim 19, further comprising a winch wound with a lifting cable, the lifting cable extending from the winch to the frame and providing a lifting end portion.

40. A catamaran lifting apparatus comprising:

a) first and second vessels;

b) a first frame that spans between the vessels;

c) a second frame that spans between the vessels;

d) each of the frames being spaced apart and each of the frames being connected to the vessels with a first connection that is a pinned connection and a second connection that is a universal joint connection in a configuration that spaces the vessels apart;

e) the first frame connecting to the first vessel with a universal joint that enables articulation and rotation about more than one axis between the first frame and the first vessel;

f) the first frame connecting to the second vessel with a pinned connection;

g) the second frame connecting to the second vessel with a universal joint that enables articulation and rotation about more than one axis between the second frame and the second vessel;

h) the second frame connecting to the first vessel with a pinned connection;

i) the vessels and frames being configured to provide a space under the frames and in between the vessels, enabling a package to be lifted to be positioned in between the vessels and under the frames; and j) wherein each frame is supported by two of the vessels with a generally triangular support arrangement defined by the pinned connection being one side of the generally triangular support arrangement and the universal joint being an apex of the generally triangular support arrangement.

41. The catamaran lifting apparatus of claim 1, wherein each vessel has vessel sides and each frame rotates at a said hinged connection about a line generally parallel to a vessel side.

42. The catamaran lifting apparatus of claim 10, wherein each vessel has vessel sides and each frame rotates at a said hinged connection about a line generally parallel to a vessel side.

43. The catamaran lifting apparatus of claim 19, wherein each vessel has vessel sides and each frame rotates at a said hinged connection about a line generally parallel to a vessel side.

44. The catamaran lifting apparatus of claim 40, wherein each vessel has vessel sides and each frame rotates at a said pin connection about a line generally parallel to a vessel side.

45. The catamaran lifting apparatus of claim 40 wherein the first frame is a truss.

46. The catamaran lifting apparatus of claim 40 wherein the second frame is a truss.

47. The catamaran lifting apparatus of claim 40 wherein the pin connection includes multiple pinned connections.

48. The catamaran lifting apparatus of claim 40 wherein the first frame is much wider at one end portion than at its other end portion.

49. The catamaran lifting apparatus of claim 40 wherein the first frame is much wider at one end portion than at its other end portion.

50. The catamaran lifting apparatus of claim 40 wherein the multiple pinned connections extend along the vessel deck a distance that defines one side of the generally triangular support arrangement.

51. The catamaran lifting apparatus of claim 40, further comprising a lifting line rigged to at least one of the frames.

52. The catamaran lifting apparatus of claim 40 further comprising a lifting line rigged to each of the frames.

53. The catamaran lifting apparatus of claim 40, further comprising a winch wound with a lifting cable, the lifting cable extending from the winch to the frame and providing a lifting end portion.

* * * * *